US005385437A

United States Patent [19]

Lonardi et al.

[11] Patent Number: 5,385,437

[45] Date of Patent: Jan. 31, 1995

[54] DEVICE FOR CHARGING A PRESSURIZED ENCLOSURE

[75] Inventors: Emile Lonardi; Gilbert Bernard; Giovanni Cimenti; Jean-Jacques Venturini, all of Luxembourg, Luxembourg

[73] Assignee: Paul Wurth S.A., Luxembourg, Luxembourg

[21] Appl. No.: 206,138

[22] Filed: Mar. 3, 1994

[30] Foreign Application Priority Data

Mar. 4, 1993 [LU] Luxembourg ..... 88232

[51] Int. Cl.[6] ..... F27B 11/00

[52] U.S. Cl. ..... 414/204; 414/199; 414/202; 414/170

[58] Field of Search ..... 414/147, 167–170, 414/199–205, 292

[56] References Cited

U.S. PATENT DOCUMENTS

| | | | |
|---|---|---|---|
| 2,674,382 | 4/1954 | Tesch et al. | 414/205 X |
| 2,954,884 | 10/1960 | Wilkening | 414/203 X |
| 3,070,242 | 12/1962 | Berczynski | 414/202 |
| 3,116,842 | 1/1964 | Mohr | 414/202 |
| 3,152,703 | 10/1964 | Slagley, Jr. | 414/203 X |
| 3,679,192 | 7/1972 | Powell | 414/170 X |
| 3,704,992 | 12/1972 | Nieboer | 414/169 X |
| 4,512,702 | 4/1985 | Mailliet et al. | 414/205 X |
| 4,878,655 | 11/1989 | Henneken et al. | 414/203 X |
| 5,046,908 | 9/1991 | Cimenti et al. | 414/170 X |

FOREIGN PATENT DOCUMENTS

| | | | |
|---|---|---|---|
| 2195425A | 4/1988 | United Kingdom . | |
| 1659492 | 6/1991 | U.S.S.R. | 414/204 |

*Primary Examiner*—Michael S. Huppert
*Assistant Examiner*—James W. Keenan
*Attorney, Agent, or Firm*—Fishman, Dionne & Cantor

[57] ABSTRACT

A device is provided for charging a pressurized enclosure, particularly a blast furnace. The device comprises a closing off bell which is movable inside a hopper and is used to close off a discharge opening. A lower sealing member encompasses a closing off element set out below the bell and is capable of moving axially with respect to the latter, and a seat is mounted below the discharge opening. The closing off element is equipped with an inflatable seal, and its seat is equipped with a first peripheral sealing surface which is substantially vertical or points downwardly. The inflatable seal interacts with the first sealing surface in order to ensure sealing of the pressurized enclosure with respect to the hopper.

14 Claims, 5 Drawing Sheets

DEVICE FOR CHARGING A PRESSURIZED ENCLOSURE

BACKGROUND OF THE INVENTION

This invention relates generally to a device for charging a pressurized enclosure with a solid material. More particularly, this invention relates to a device for charging a blast furnace having a rotary and/or tilting distribution chute with a predetermined flow rate of a solid material.

Devices of this sort are used, for example, in blast furnaces, more specifically in blast furnaces which are equipped with a tilting and/or rotary distribution chute. The hopper then constitutes a receptacle for vertically sealing off the charging material and furthermore includes a lower member which makes it possible to isolate the hopper with respect to the pressurized furnace.

A device of this sort, which is designed to equip a blast furnace furnished with a rotary and/or tilting distribution chute, is known from Patent document EP-A-0,062,770. Patent document EP-A-0,062,770 discloses a combined member for retaining and for regulating the flow rate of material, which comprises two registers in the form of spherical caps, the relative movement of which makes it possible to vary the passage section symmetrically about the central outflow axis of the material. These registers are set out in a leaktight chamber, situated directly below the hopper. This leaktight chamber is equipped at its lower end with the lower sealing member. The lower sealing chamber comprises a shutter which can be pivoted between a lateral position, in which it is sheltered from the material discharged from the hopper, into a closing off position, in which it is transverse to the outflow axis for the material. In this closing off position the shutter can be applied, through an axial translation movement, onto a seat. This seat peripherally surrounds the discharge opening of the hopper, and is equipped with a sealing surface pointing downwards, that is to say in the direction of outflow of the material.

A device of the son known from Patent document EP-A-0,062,770, is capable of giving complete satisfaction from the point of view of regulating the flow rate and from the point of view of sealing, even for an enclosure in which high working pressures prevail. Its main drawback is its high assembly height, which results from the fact that the combined member for retaining and for regulating the flow rate of material and the sealing member are superimposed below the hopper. To overcome this drawback, if required, it would, for example, be possible to envisage replacing the lower sealing shutter situated below the hopper by a lower sealing member which is incorporated directly into the hopper.

From Patent document EP-A-0,088,253, a device is known for charging a blast furnace, of the sort described hereinabove which is equipped with a combined member for retaining and for regulating the flow rate of material. This device comprises a bell which is incorporated into the materials hopper. This bell, which has the form of an axisymmetric cone flaring out in the direction of its lower edge, can be moved vertically along the axis of the hopper. In the lowered position, it interacts with a first seat set out at the level of the discharge opening of the hopper in order to close the above mentioned hopper off. In the raised position, it defines an annular outflow opening between the funnel-shaped wall of the hopper and its lower edge. The passage section of this annular opening depends on the vertical travel of the bell. Now, it is well known that with a bell of this sort, there is no guarantee of satisfactory regulation of the flow rate of material. In order to alleviate this drawback, Patent document EP-A-0,088,253 proposes equipping the bell, on the side of its lower edge, with an oblong and pointed body which is coaxial with the central axis of the discharge opening and which extends axially through the discharge opening in the direction of the pipe for feeding the chute. The profile of this body should then theoretically make it possible to determine the regulation characteristic, that is to say the function "flow rate of material/vertical travel of the retaining and regulating member". The result obtained is, however, rather disappointing.

Patent document EP-A-0,088,253 also proposes a lower sealing member which is incorporated into the hopper. This sealing member comprises a closing off disc, which is set out below the bell and equipped with a peripheral seal on the side of its lower face. When the bell bears on its seat, the disc may be applied axially to a second seat. The second seat, which is situated below the first seat, has a passage section which is smaller than the first seat and is equipped with a sealing surface pointing towards the inside of the hopper. This leaktight member does not, however, give satisfaction. Indeed, this second seat, which is exposed to wear by the materials flowing out through the discharge opening, is rapidly deteriorated and is therefore no longer capable of ensuring closure which is leaktight with respect to the pressurized gases.

Now, on the other hand, if it is desired, to replace the lower sealing member, which is incorporated into the hopper, in the charging device of Patent document EP-A-0,088,253, by a pivotable sealing shutter, of the sort of the one which is known from Patent document EP-A-0,062,770, any advantage from the assembly height point of view is lost. Indeed, when the bell is bearing on its seat, the aforementioned oblong and pointed body is necessarily situated below the discharge opening of the hopper. Since the pivotable sealing shutter cannot pass through the oblong body, it is consequently necessary to provide, below the materials hopper, a leaktight chamber into which this oblong body can penetrate with its entire length. The sealing shutter will then be incorporated into the lower end of this leaktight chamber, the height of which is certainly not less than the height of the leaktight chamber enclosing the aforementioned registers in the form of spherical caps which are known from Patent document EP-A-0,062,770.

Based on the foregoing, there is a need to provide a device for charging a pressurized enclosure, with a solid material, in which the lower sealing member is incorporated into the hopper, but which does not have all the disadvantages mentioned above for the device of Patent document EP-A-0,088,253.

SUMMARY OF THE INVENTION

The above-discussed and other problems and deficiencies of the prior an are overcome or alleviated by the device for charging a pressurized enclosure of the present invention. In accordance with the present invention, a device for charging a pressurized enclosure with a solid material in which the lower sealing member is incorporated into the hopper and also a member for regulating the flow rate is provided which comprises (1)

a materials hopper forming a vertical sealing-off receptacle which includes a funnel-shaped lower pan defining a substantially vertical central outflow axis for the material, (2) a feeding pipe for the pressurized enclosure which is situated axially below the lower pan of the hopper, (3) a closing off bell movable inside the hopper between a lower position for closing off a discharge opening in the funnel-shaped lower part and an upper position for freeing the discharge opening and a lower sealing member including a closing off element set out below the bell so as to be axially movable with respect to the bell, (4) a seat mounted axially below the discharge opening, (5) means for moving the closing off element between a protected position below the bell and an operational position outside the bell when the bell is in the lower closing off position, wherein the closing off element includes a lateral peripheral surface into which there is incorporated an inflatable seal, and the seat includes a first peripheral sealing surface which is substantially vertical or points slightly downwards and which surrounds and faces the inflatable seal when the closing off element is in the operational position.

The device that is provided in accordance with the present invention distinguishes from the known device of Patent document EP-A-0,088,253 by a distinctly greater durability of the lower sealing member of the hopper. The seat of the closing off element, ensuring sealing of this device, offers a sealing surface which is more or less vertical or points downwards, that is to say in the direction of outflow of the material. What is important, is that the sealing surface does not point towards the inside of the materials hopper. In this way, the sealing surface is therefore not exposed to wear by the materials flowing out through the discharge opening and the risk of solid particles adhering thereto is negligible.

Sealing between this sealing surface and the closing off element is guaranteed by the seal which can be inflated by liquid or gas, laterally surrounding the closing off element. This seal is always protected by the bell and is therefore no longer subjected to wear by the charging materials. It is to be understood and noted that the term "bell" encompasses any body capable of closing off the discharge opening, even if this body does not have the form of a bell.

In a preferred embodiment, the seat is equipped with a second peripheral sealing surface which is situated upstream of the first peripheral sealing surface and points towards the closing off element. The closing off element is equipped with a peripheral edge upstream of the seal, which bears on the second sealing surface when the sealing element is in the operational position. In this embodiment, the second sealing surface constitutes, firstly, a stop for the closing off element and in this way makes it possible to define the operative position exactly. What is more, the peripheral edge bearing on the second sealing surface constitutes an effective protection of the inflatable seal against materials flowing out accidently between the bell and the wall of the hopper.

This peripheral edge will moreover advantageously be equipped with a flexible or sort seal, for example an elastomeric seal, which interacts with the second leaktight surface. It is, however, also possible to envisage a metal/metal contact. In this case, it is advantageous to give the peripheral edge the form of a spherical ring and the second leaktight surface the shape of a conical ring.

Preferably, the first sealing surface describes a cone frustum flaring out downwardly, that is to say downstream, and the second sealing surface describes a cone frustum flaring out upwardly, that is to say upstream.

The seat is preferably equipped with an annular chamber surrounding at least the first sealing surface, and this chamber is connected to at least one feed duct and to at least one return duct for a fluid. It is therefore possible to make a fluid, preferably a liquid, circulate in this annular chamber, the temperature and/or flow rate of which fluid are chosen so that the temperature of the sealing surface is neither below the dew point, in order to avoid condensation on the sealing surface, nor too high so as to avoid damaging of the inflatable seal bearing on it. By avoiding condensation of moisture on the sealing surfaces not only is corrosion of the sealing surfaces prevented; but dust is prevented from remaining stuck on these surfaces, which dust would prevent a leaktight contact with the seal and would additionally lead to rapid deterioration of the seal.

The inflatable seal preferably defines an annular chamber which is connected to at least one feed duct and to at least one return duct for a fluid. In this way, the inflatable seal may be cooled directly by a fluid, preferably a liquid, circulating through the annular chamber. In order to inflate the inflatable seal, it is therefore sufficient to increase the pressure of the fluid in the aforementioned feed ducts.

The closing off element is preferably equipped at its periphery with an annular passage connected to a source of compressed air or of a pressurized gas, and this annular passage is therefore equipped with at least one blowing orifice pointing obliquely downwards. This embodiment makes it possible to clean the first and the second sealing surfaces when the closing off element is lowered onto its seat.

The funnel-shaped lower part of the materials hopper preferably has an internal surface which, directly upstream of the seat, exhibits an abrupt and pronounced increase in its slope. This abrupt and pronounced discontinuity in the slope causes particles of material to be thrown beyond the second sealing surface, which points towards the inside of the hopper, which decreases wear on this surface.

The device in accordance with the present invention advantageously comprises a member for regulating the flow rate of material. This member for example comprises two registers in the form of spherical caps, defining, via their relative movement, a variable passage section which is symmetric with respect to the central outflow axis for the material. This embodiment makes it possible to obtain excellent results relative to regulating the flow rate of the material.

Alternately, the member for regulating the flow rate of material may, however, also include a central metering body which is oblong and distinctly more slender than the bell, coaxial with the central outflow axis and capable of moving along the outflow axis, relatively with respect to the bell, so as to penetrate through the discharge opening in the direction of the feed pipe to a greater or lesser extent. The closing off element is then equipped with a central opening for the passage of the central regulating body, and the device includes sealing means between the inside of the hopper and the central opening. This embodiment of the device results in a particularly small assembly height, while giving complete satisfaction from the point of view of quality of the sealing member and quality of the regulating member.

In effect, contrary to the device known from Patent document EP-A-0,088,253 , the central metering body is no longer a constituent element of the bell, but an independent element, the position of which with respect to the discharge opening may be adjusted independently with respect to the position of the bell in the materials hopper. This feature makes it possible to place the bell at a distance from the discharge opening, in which it practically no longer influences the flow rate which flows out through this opening. The flow rate may therefore be regulated essentially by the movement of the central metering body. It then follows that the regulation characteristic, that is to say the function $Q=f(C)$, in which Q is the flow rate of material flowing out through the discharge opening and C is the travel of the central metering body, may be determined by the choice of longitudinal profile of the oblong and slender body, which now satisfactorily fulfills its role of central metering body.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
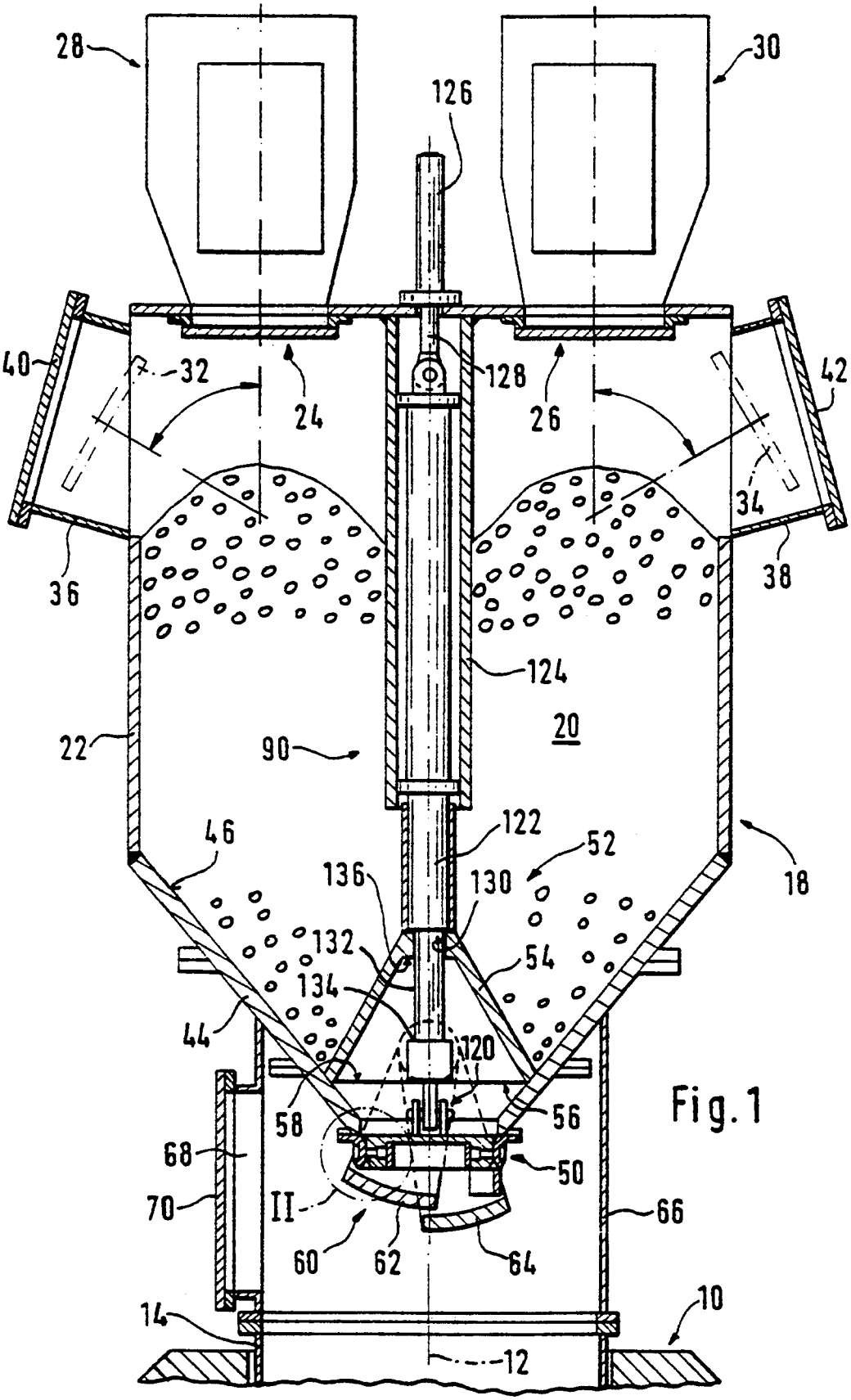
FIG. 1 is a diagrammatical elevation (vertical) sectional view of a device for charging a pressurized enclosure in accordance with the present invention.

Referring first to FIG. 1, a first embodiment of the device for charging a pressurized enclosure is shown generally in diagrammatical cross-section by the entire FIG. 1.

The reference 10 denotes a casing of a mechanism for driving a rotary or tilting distribution chute (not represented), which is mounted in a blast furnace. The reference 12 denotes the vertical axis of the blast furnace. A feed pipe 14 passes axially through the casing 10 to feed the distribution chute with charging material, for example coke, sinter, pellets, etc. This feed pipe 14 is coaxial with the vertical axis 12 of the blast furnace.

The reference 18 denotes, generally, a materials hopper which constitutes a receptacle for sealing off the charging material from the blast furnace. This material is denoted inside the hopper 18 by the reference 20. The materials hopper 18 comprises upper pan 22 having the form of a cylinder coaxial with the vertical axis 12. Two charging openings 24 and 26, for example, via which the hopper 18 may be filled are set out in this upper part 22. Filling takes place for example, in a way known per se, through the use of two conveyors with skips 28 and 30.

Each of these charging openings 24 and 26 is equipped with an upper sealing shutter 32 and 34. These upper sealing shutters 32, 34 guarantee, in the closed position, sealing of the hopper with respect to the outside atmosphere. In FIG. 1 they are represented, by broken lines, in the open position. It is noticed that, in this open position, they are each situated in a lateral pipe 36, 38 of the hopper 18, where they are sheltered from the material discharged by the skips 28, 30 through the charging openings 24 and 26. Each of these pipes 36, 38 is provided with a removable closing off plate 40, 42 which allows access to the respective shutter for maintenance work.

The upper part 22 of the materials hopper 18 is extended into a lower part 44 which has the form of a funnel. This funnel 44 itself has, for example, the shape of an axisymmetric cone frustum, of circular or oval transverse section, which is coaxial with the axis 12. The vertex angle of the axisymmetric cone lies, for example, between 60° and 80°, which corresponds to a slope of an internal wall 46 of the order of 50° to 60°.

A lower opening 48 (see FIG. 2), coaxial with the axis 12, is equipped with a lower sealing member 50. Lower sealing member 50 ensures, in the closed position, sealing of the hopper 18 with respect to the blast furnace.

Above the lower sealing member 50, the hopper is equipped with a material retaining member 52. The material retaining member 52 includes, for example, a bell 54 which has the form of a hollow cone frustum which is coaxial with the axis 12 and which flares out in the direction of a lower horizontal edge 56. In FIG. 1, the bell 54 is represented in a closing off position in which it bears with its lower edge 56 on the inner wall 46 of the hopper 18, so as to close off a passage section 58 in the conic part 44 of the hopper 18, upstream of the sealing member 50. In other words, this passage section 56 constitutes a discharge opening of the hopper 18, which can be closed off by the bell 54 and which can be freed by drawing the bell 54 back upwards.

Directly below the lower sealing member 50 is installed a flow rate regulating member 60. The flow rate regulating member 60 comprises, in the device represented in FIG. 1, two registers in the form of spherical caps 62 and 64, the relative movement of which, about a common horizontal axis intersecting the vertical axis 12 of the device, makes it possible to vary the passage section symmetrically about the central outflow axis of the material.

The space necessary for the pivoting of the registers 62 and 64 below the hopper 18 is obtained by connecting the hopper 18, with the aid of a leaktight chamber 66, to the feed pipe 14. A lateral pipe 68, equipped with a removable closing off plate 70, makes it possible to have access to the inside of the leaktight chamber 66 for maintenance work.

Figure 2:
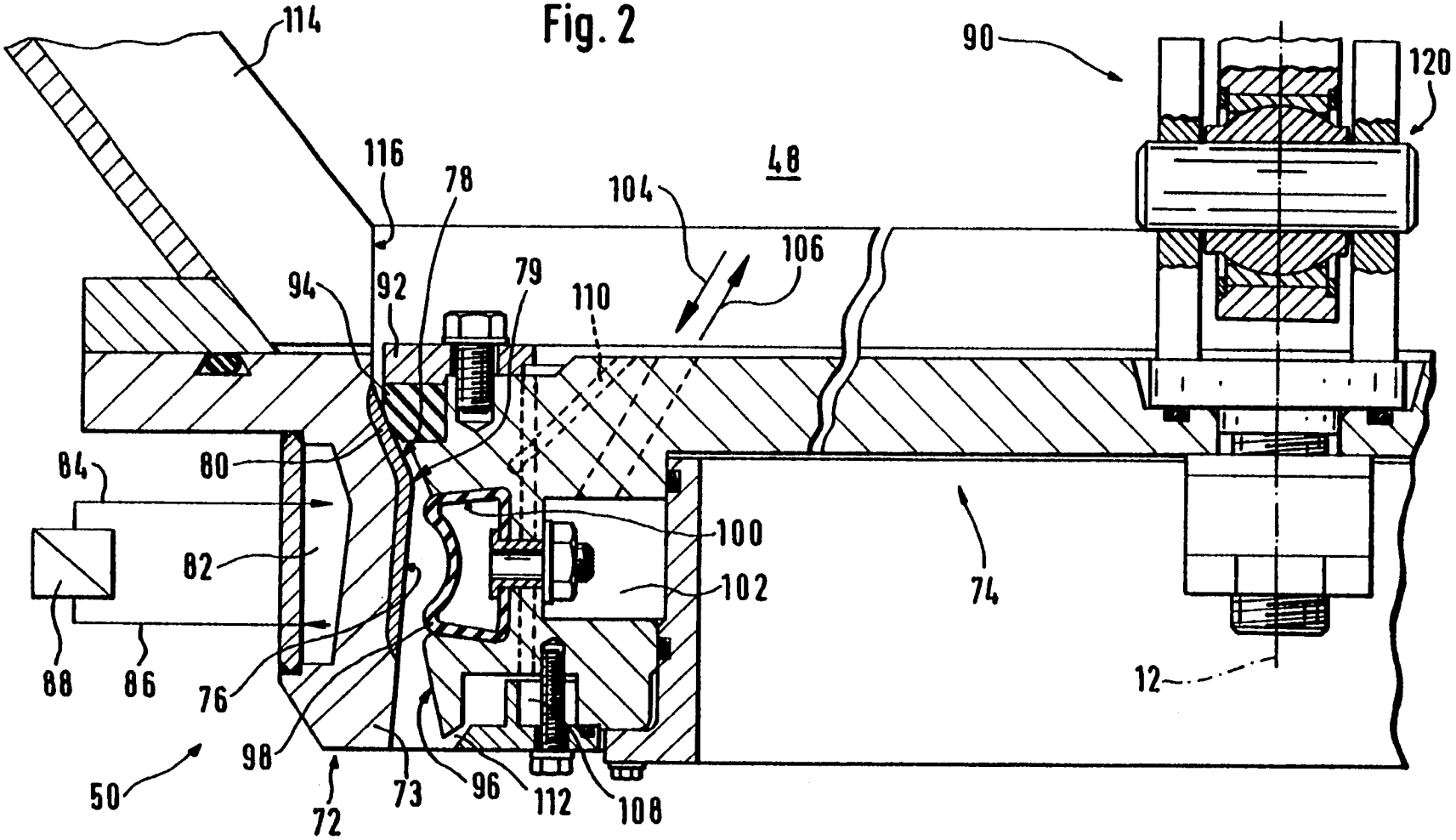
FIG. 2 is a cross-sectional elevation view in detail of the lower sealing member of the device of FIG. 1.

The lower sealing member 50 is described with the aid of FIG. 2. It comprises a seat 72 mounted leaktightly on the hopper 18 level with the lower opening 48 and a closing off element 74 having the form of a disc.

The seat 72 has the form of a sleeve 73 which is coaxial with the axis 12. On the inside, this sleeve 73 is equipped with a first sealing surface 76 and with a second sealing surface 78. The first sealing surface 76 describes an axisymmetric cone frustum which is coaxial with the vertical axis 12 of the device and which flares out slightly in the direction of outflow of the material. The second sealing surface 78, which is situated upstream of the first sealing surface 76, describes an axisymmetric cone frustum which is coaxial with the vertical axis 12 of the device and which flares out towards the inside of the materials hopper 18. At their intersection, the two surfaces define a restriction neck 79. The two sealing surfaces 76, 78 are preferably coated with an anti-abrasive and anti-corrosive coating 80.

On the outside, the sleeve 73 is equipped with an annular passage 82 which surrounds the two sealing surfaces 76 and 78. This passage 82 is equipped with feed and return connection ducts for a fluid. These ducts are represented diagrammatically by the arrows 84 and 86 in FIG. 2. The reference 88 diagrammatically represents a unit for conditioning a fluid, in such a way that the temperature of the fluid circulating in the annular passage 82 is such that the surface temperature of the sealing surfaces 76 and 78 is never below the dew point, in order to prevent condensation, and never above a predetermined limiting temperature.

The closing off element 74 has the form of a disc. This disc is set out directly below the bell 54, so that its central axis is coaxial with the axis 12. A control member 90 which is described later, makes it possible to translate the closing off element 74 axially between a protected position, in the hollow of the bell 54, and an operational position, outside the bell 54.

In FIG. 2, the closing off element 74 is shown in the operational position, whereas the bell 54, not shown in this figure, is in the lower position for closing off the discharge opening 58. It is seen that the closing off element 74 is, in this position, applied with an upper peripheral edge 92, which is for example equipped with an elastomeric seal 94, against the second leaktight surface 78 of the seal 72. A metal-to-metal contact is, however, also envisageable. From this upper peripheral edge 92, the closing off element 74, laterally delimited by a lower peripheral surface 96, decreases in transverse section. As a result, the lower end of the closing off element 74 can penetrate axially through the restriction neck 79 into the space surrounded by the first sealing surface 76.

An inflatable elastomeric seal 98 is housed in an annular cavity 100 which is set out in the lower peripheral surface 96. In the operational position, this inflatable seal 98 faces the first sealing surface 76. When it is deflated, the seal 98 is set back with respect to the lower peripheral surface 96 (cf. FIG. 2). When it is inflated, that is to say pressurized by a fluid, the seal 98 is, in contrast, firmly applied to the first sealing surface 76 and thus provides the sealing between the closing off element 74 and the seat 72. An annular passage 102, which is set out in the closing off element 74, feeds the inflatable seal 98 with the pressurizing fluid. This feed passage 102 is preferably equipped with feed and return connection ducts, represented diagrammatically by the arrows 104 and 106. In this way, a circulation of the fluid can be built up in the inflatable seal 98 in order to cool it. This fluid may, moreover, be identical to the fluid circulated through the annular passage 82 of the seat.

In a lower peripheral edge of the closing off element 74, there is set out an annular passage 108 which is connected by a passageway 110 to a compressed air circuit or a source of pressurized gas. This annular passage 108 feeds an annular orifice 112, which points obliquely downwards. When the closing off element 74 is lowered into its seat 72, the air blown through this annular orifice 112 cleans the second, then the first sealing surface from the top downwards.

It will be appreciated that the inner wall of the hopper 18 consists of a wear coating 114, with a slope of approximately 50° to 60°. This slope is interrupted by a vertical cylindrical surface 116, vertically above the second sealing surface 78. In this way, the particles of material flowing out along this wear coating 114 are thrown above the second sealing surface 78.

The operation of the lower sealing member 50 will be described with the aid of FIGS. 3, 4 and 5.

Figure 3:
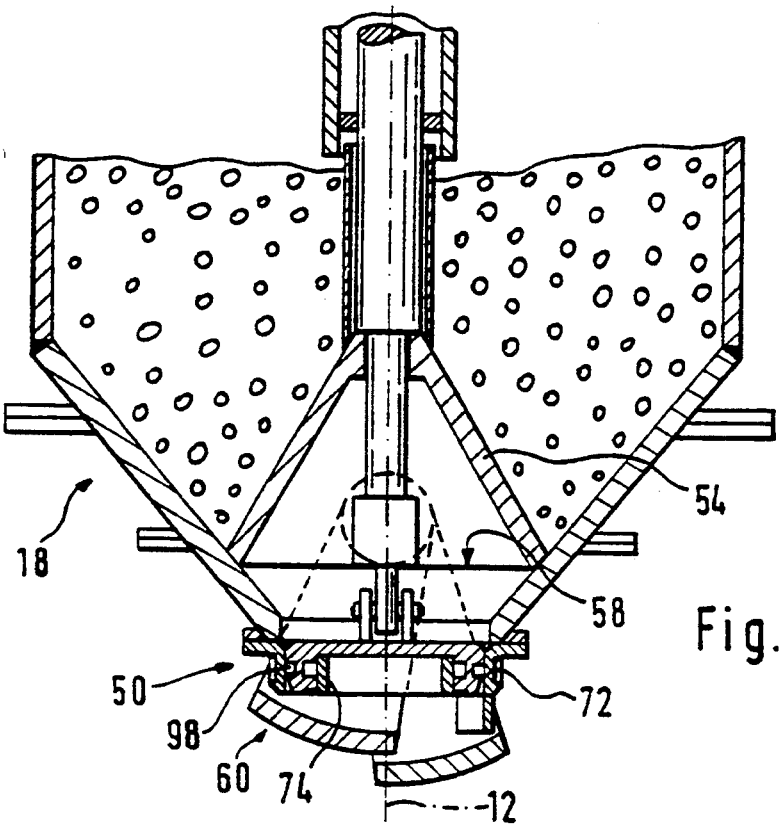
FIGS. 3–5 are sequential diagrammatical elevation views depicting the operation of the device of FIG. 1.

In FIG. 3, the bell 54 is entirely lowered into its position for closing off the outflow opening 58. The material 20 is consequently retained by the bell 54 upstream of the sealing member 50. Sealing member 50 isolates the materials hopper with respect to the shaft furnace, or any other pressurized receptacle. For this purpose, the closing off element 74 is bearing on its seat 72, and the inflatable seal 98 is inflated by a pressurized fluid. The metering member 60 is preferably entirely closed and thus constitutes a lower protection of the sealing member 50.

Figure 4:
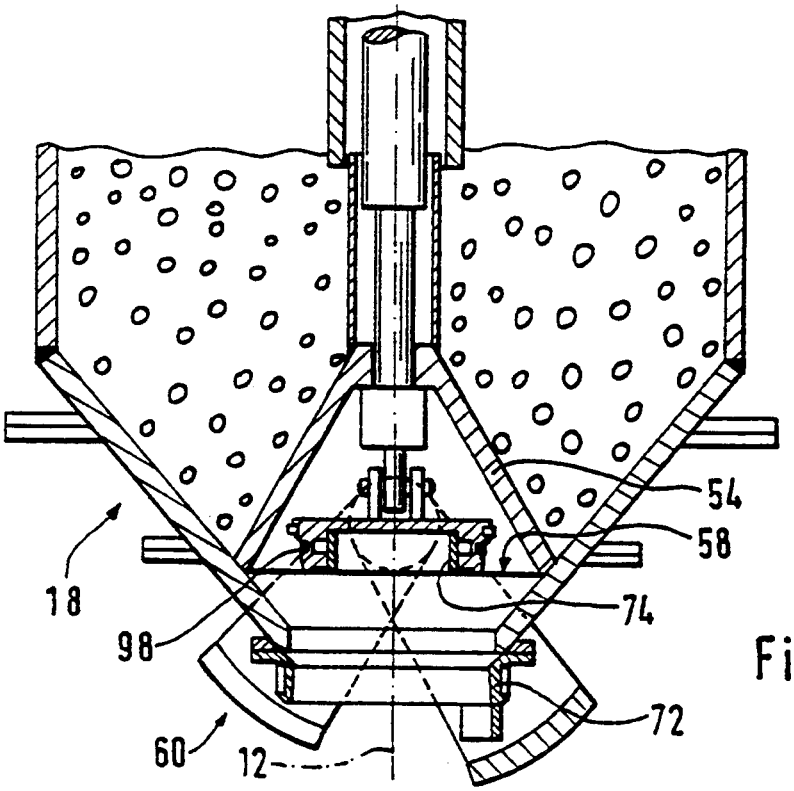

In FIG. 4, the bell 54 still closes off the outflow opening 58 but, from the pressure point of view, the materials hopper 18 is already in communication with the pressurized receptacle. In effect, the inflatable seal 98 has been deflated and the closing off element 74 has been drawn back upwards below the bell 54, more specifically into the hollow of the bell 54. The regulating member 60 is open, in order to free the passage section which corresponds to the flow rate of material which it is desired to obtain.

Figure 5:
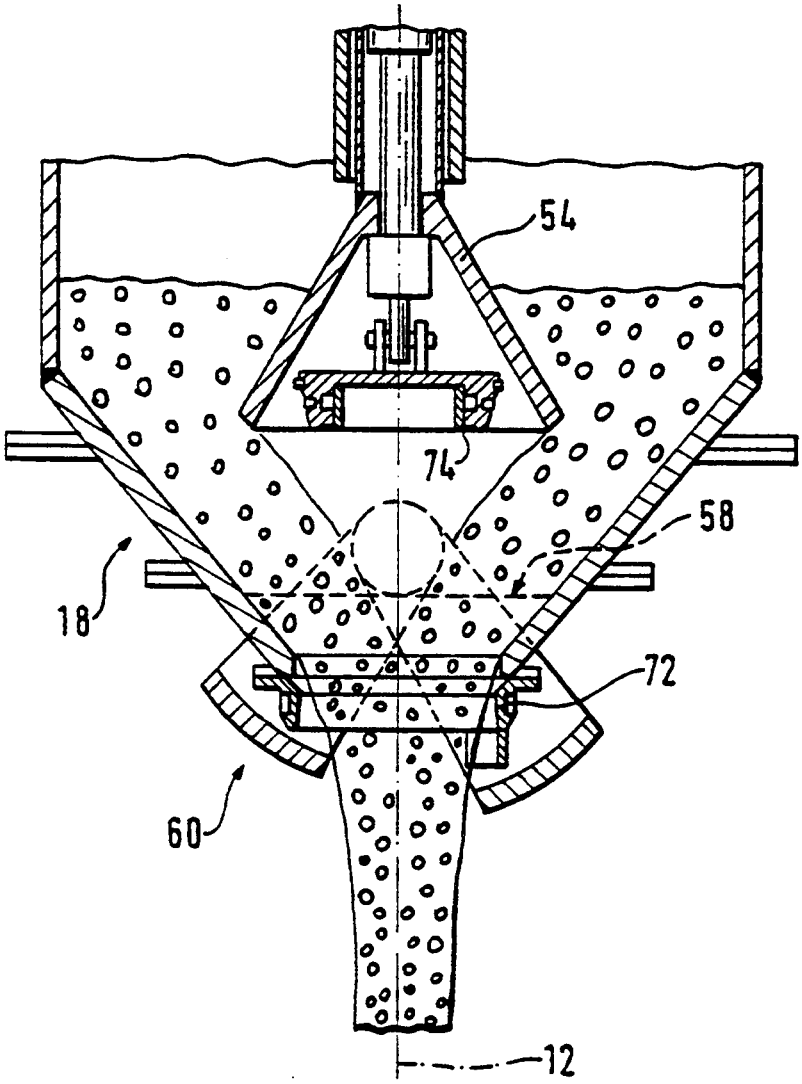

In FIG. 5, the bell 54 is shown in the raised position, freeing the outflow opening 58. The closing off element 74 is still in the protected position inside the bell 54. The flow rate of material flowing out of the hopper 18 is determined by the regulating member 60.

In order to isolate the materials hopper 18 from the pressurized receptacle again, firstly the bell 54 is lowered into its closing off position and the regulating member 60 is closed. Then the closing off element 74 is lowered outside of its protected position, in order to apply it to its seat 72. Lastly, the inflatable seal 98 is inflated in order to ensure sealing (cf. FIG. 1).

One embodiment of the control member 90, ensuring the movement of the bell 54 and of the closing off element 74, is described with the aid of FIG. 1. The closing off element 74 is mounted with the aid of an articulation 120 on the lower end of a control rod 122 which is coaxial with the axis 12. The articulation 120 is preferably an articulation with two mutually perpendicular axes of pivoting; which allows the closing off element 74 to better position itself on its seat 72. The control rod 122 is guided in a sheath 124 which is coaxial with the axis 12 and fixed to the upper end of the materials hopper 18. A thrust cylinder 126, mounted outside the hopper 18, penetrates with its thrust cylinder rod 128 into the sheath 124, where it is axially connected to the upper end of the control rod 122. The bell 54 is equipped at its upper end with a bore 130 in which the control rod 122 can freely slide over a bearing surface 132. This bearing surface 132 of the rod 122 ends in a lower shoulder 134 which points upwards, so that it can bear on a bearing surface 136 of the bell 54, which bearing surface is arranged around the bore 130 and points downwards. When the thrust cylinder 126 draws the rod 122 back upwards, the rod 122 draws the closing off element 74 back into the bell 54, which firstly remains immobile. Next, the shoulder 134 of the rod 122 bears on the bearing surface 136 of the bell 54 in order to raise the bell 54. The thrust cylinder 126 must consequently be dimensioned to deliver the tractive load necessary for raising the bell 54 through the material 20.

Of course, the bell 54 could also be equipped with an independent drive system.

Figure 6:
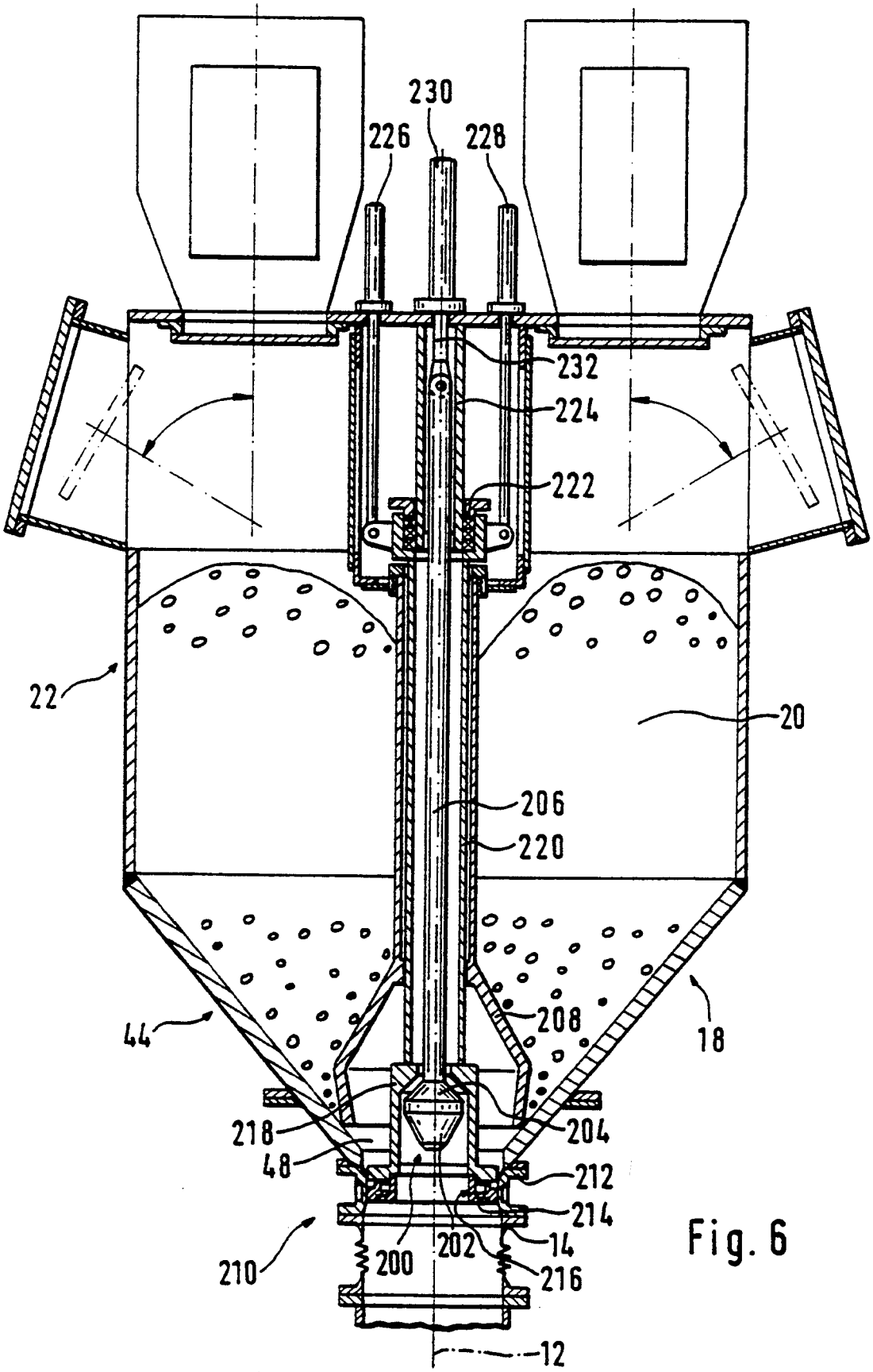
FIG. 6 is a diagrammatical elevation (vertical) sectional view of an alternate embodiment of the device of FIG. 1.

FIG. 6 shows a second preferred embodiment of the device of FIG. 1. As a replacement for the materials regulating member 60, which was equipped with two spherical caps 62 and 64, the device of FIG. 6 comprises a central metering body 200. This is, for example, an axisymmetric body, a lower part 202 of which flares out from the bottom upwards, and an upper part 204 of which tapers progressively towards a control rod 206. The central metering body 200 and the control rod 206 are coaxial with the axis 12. The axial positioning of the central metering body 200 in the lower opening 48 of the hopper 18, delimits in the hopper 18 an annular passage opening. The section of this annular passage opening is determined by the transverse section of the central metering body 200 level with this lower opening 48. When the central metering body 200 is moved with respect to the lower opening 48, the passage section in the lower opening varies in consequence depending on the profile of the body 200.

A bell 208 corresponds to the bell 54 of FIG. 1. It constitutes a member for retaining the material upstream of a sealing member 210, which includes a seat 212, identical to the seat 72 of FIG. 2, and a closing off element 214. Closing off element 214 can be distinguished from the closing off element 74 of FIG. 2 in that it is equipped with a central opening 216 for the passage of the central metering body 200. Above the opening 216 is fixed, in leaktight fashion, a sleeve 218 into which the central metering member 200 may be retracted. At its upper end, the sleeve 218 is extended by a tube 220, which is guided in leaktight fashion, for example with the aid of a packing gland 222, on a fixed sleeve 224. The fixed sleeve 224 is fixed to the hopper 18, so that it is coaxial with the axis 12. The inside of the sleeve 218, of the tube 220, and of the fixed sleeve 224, are consequently situated, from the pressure point of view, on the pressurized enclosure side.

Two thrust cylinders 226 and 228 are connected between the tube 220 and the hopper 18. The control rod 206 is installed inside the tube 220 and penetrates with its upper end into the fixed sleeve 224. A third thrust cylinder 230 penetrates axially with its piston rod 232 into the fixed sleeve 224, where this piston rod 232 is connected to the upper end of the control rod 206.

It will be noted that it is the thrust cylinders 226 and 228 which make it possible to raise the bell 208 through the material 20. For this purpose, the bell 208 can slide along the tube 220. When the tube 220 is raised by the thrust cylinders 226 and 228, the bell 208 firstly remains immobile, and the closing off element is drawn back inside the bell 208. At the moment at which the upper end of the sleeve 218 bears on the bell 208, the bell 208 is raised from its seat in order to be raised up by the tube 220, together with the closing off element 214. The thrust cylinder 230 is used purely to position the central metering element 200.

It will be noted that in the device of FIG. 6, the three members, material retaining member 208, member 202 for regulating the flow rate of the material 20, and the lower sealing member 210 are all incorporated into the materials hopper 18. This feature makes it possible to connect the lower outlet opening 48 of the materials hopper 18 directly to the charging pipe 14 without passing through an intermediate leaktight chamber of the type shown at 66 in FIG. 1. This results in an appreciable saving in assembly height.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for charging a pressurized enclosure with a solid material, comprising:

a materials hopper forming a vertical sealing-off receptacle which includes a funnel-shaped lower part defining a substantially vertical central outflow axis for the material:

a feeding pipe for the pressurized enclosure which is positioned axially below said lower pan of the hopper;

a closing off bell movable inside the hopper between a lower position for closing off a discharge opening in said funnel-shaped lower pan and an upper position for freeing said discharge opening;

a lower sealing member including a closing off element set out below the bell so as to be axially movable with respect to the bell, a seat mounted axially below the discharge opening, means for moving the closing off element between a protected position below the bell and an operational position outside the bell when the bell is in said lower closing off position; and wherein the closing off element includes a lateral peripheral surface into which there is incorporated an inflatable seal and the seat includes a first peripheral sealing surface which is substantially vertical or inclines downwardly and which surrounds and faces the inflatable seal when the closing off element is in the operational position.

2. The device of claim 1, wherein:

said scat further includes a second peripheral sealing surface which is positioned upstream of the first peripheral sealing surface and which inclines towards the closing off element and the closing off element further includes a peripheral edge which is positioned upstream of the inflatable seal such as to bear on the second peripheral sealing surface when the closing off element is in the operational position.

3. The device of claim 2 wherein:

the peripheral edge of the closing off element forms a spherical ring, and the second sealing surface has the shape of a cone frustum flaring out upwardly.

4. The device of claim 2 wherein:

the peripheral edge of the closing off element includes a seal which interacts with the second sealing surface.

5. The device of claim 2 wherein the first sealing surface has the shape of a cone frustum flaring out downwardly, and the second sealing surface has the shape of a cone frustum flaring out upwardly.

6. The device of claim 1 wherein the seat is equipped with an annular chamber surrounding at least the first sealing surface, and this annular chamber is connected to at least one feed duct and at least one return duct for a fluid.

7. The device of claim 6 wherein the feed and return ducts are connected to a unit for conditioning a fluid, and ensuring a circulation of this fluid through the annular chamber, and the conditioning unit comprises means for adjusting at least one of the temperature and the flow rate of this fluid, such that the temperature of the sealing surface is neither below the dew point, nor above a limiting working temperature of the inflatable seal.

8. The device of claim 1 wherein the inflatable seal is connected to a source of liquid or gas under pressure.

9. The device of claim 8, wherein the inflatable seal is connected to at least one feed duct and at least one return duct for a cooling fluid.

10. The device of claim 1 wherein the closing off element is equipped with an annular passage connected to a source of compressed air or of pressurized gas, and this annular passage includes at least one blowing orifice, positioned in the lateral peripheral surface, below the inflatable seal and directed downwardly.

11. The device of claim 1 wherein the materials hopper, in the funnel-shaped lower part, has an internal surface which, directly upstream of the seat, exhibits an abrupt and pronounced increase in its slope.

12. The device of claim 1 comprising a member for regulating the flow rate of the material flowing out through the discharge opening.

13. The device of claim 12, wherein the member for regulating the flow rate of material includes two registers in the form of spherical caps, defining, via their relative movement, a variable passage section which is symmetric with respect to the central outflow axis.

14. The device of claim 12, wherein the member for regulating the flow rate of material includes a central metering body which is oblong and more slender than the bell, coaxial with the central outflow axis and movable along the central outflow axis relatively with respect to the bell, so as to penetrate through the discharge opening in the direction of the feed pipe to a greater or lesser extent; the closing off element further including a central opening for the passage of the central metering body; and the device further including sealing means between the hopper and the central opening.

* * * * *